US008939735B2

(12) United States Patent
Heidecker et al.

(10) Patent No.: US 8,939,735 B2
(45) Date of Patent: Jan. 27, 2015

(54) COMPRESSOR PLUG ASSEMBLY

(75) Inventors: Matthew J. Heidecker, Troy, OH (US); David Alan Waesch, Sidney, OH (US); Jesse T. Peyton, Piqua, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 565 days.

(21) Appl. No.: 12/730,782

(22) Filed: Mar. 24, 2010

(65) Prior Publication Data

US 2011/0076162 A1 Mar. 31, 2011

Related U.S. Application Data

(60) Provisional application No. 61/164,149, filed on Mar. 27, 2009.

(51) Int. Cl.
*F04B 35/04* (2006.01)
*F04B 39/12* (2006.01)
(Continued)

(52) U.S. Cl.
CPC ..... *F04B 39/121* (2013.01); *H01R 13/5219* (2013.01); *H01R 13/6395* (2013.01); *Y10S 417/902* (2013.01)
USPC ..... 417/410.1; 417/902; 439/271; 439/282; 310/71

(58) Field of Classification Search
CPC ..... F04B 39/121; H02K 5/22; H02K 5/225; H01R 13/5129; H01R 13/6395
USPC ..... 417/313, 401.1, 902; 439/271, 282, 439/278, 521, 577; 310/71; 277/651, 616, 277/572
See application file for complete search history.

(56) References Cited

U.S. PATENT DOCUMENTS 1,658,861 A 2/1928 Slade
1,658,862 A 2/1928 Slade
(Continued)

FOREIGN PATENT DOCUMENTS

EP 0284633 A1 10/1988
EP 0 677 727 A2 10/1995
(Continued)

OTHER PUBLICATIONS

Chinese Office Action dated Nov. 28, 2008, and English translation of the Chinese Office Action entitled "Text Portion of the First OfficeAction" provided by CCPIT Patent and Trademark Law Office on Dec. 18, 2008.
(Continued)

*Primary Examiner* — Devon Kramer
*Assistant Examiner* — Joesph Herrmann
(74) *Attorney, Agent, or Firm* — Harness, Dickey & Pierce, P.L.C.

(57) ABSTRACT

A compressor including a shell, a compression mechanism disposed within the shell, a motor actuating the compression mechanism, and a terminal body secured to the shell, may further include at least one conductor pin extending through the terminal body and a fence disposed around the terminal body and secured to the shell. A plug assembly having an inner core surrounded by an outer body includes at least one electrical receptacle housed by the inner core for selective electrical communication with the at least one conductor pin. A seal may be integrally formed with the outer body and may engage the fence when the at least one electrical receptacle is in electrical communication with the at least one conductor pin.

37 Claims, 6 Drawing Sheets

(51) Int. Cl.
*H01R 13/52* (2006.01)
*H01R 13/639* (2006.01)

(56) References Cited

U.S. PATENT DOCUMENTS

| | | | | |
|---|---|---|---|---|
| 2,205,051 | A | 6/1940 | Schmitt | |
| 2,658,185 | A | 11/1953 | Hatcher | |
| 2,728,060 | A | 12/1955 | Doeg | |
| 3,016,511 | A | 1/1962 | Unger | |
| 3,022,097 | A * | 2/1962 | Seniff et al. | 277/356 |
| 3,031,861 | A | 5/1962 | McCormack | |
| 3,417,361 | A | 12/1968 | Heller | |
| 3,605,076 | A | 9/1971 | Dozier | |
| 3,684,819 | A | 8/1972 | Wilson | |
| 3,696,321 | A | 10/1972 | Cooper, Jr. | |
| 3,850,496 | A * | 11/1974 | Hague | 439/685 |
| 3,873,656 | A * | 3/1975 | Garner | 264/55 |
| 4,059,325 | A | 11/1977 | Diminnie et al. | |
| 4,120,555 | A | 10/1978 | Shiflett et al. | |
| 4,252,394 | A | 2/1981 | Miller | |
| 4,469,923 | A | 9/1984 | Charboneau | |
| 4,480,151 | A | 10/1984 | Dozier | |
| 4,508,413 | A | 4/1985 | Bailey | |
| 4,523,798 | A * | 6/1985 | Barrows et al. | 439/685 |
| 4,551,069 | A | 11/1985 | Gilmore | |
| 4,597,581 | A * | 7/1986 | Nimberger | 277/308 |
| 4,712,430 | A | 12/1987 | Wareham | |
| 4,743,184 | A | 5/1988 | Sumikawa et al. | |
| 4,782,197 | A | 11/1988 | Stunzi et al. | |
| 4,840,547 | A | 6/1989 | Fry | |
| 4,925,404 | A * | 5/1990 | Dutcher | 439/607.01 |
| 4,964,788 | A | 10/1990 | Itameri-Kinter et al. | |
| 4,966,559 | A | 10/1990 | Wisner | |
| 4,984,468 | A | 1/1991 | Hafner | |
| 4,984,973 | A | 1/1991 | Itameri-Kinter et al. | |
| 5,035,653 | A | 7/1991 | Honkomp et al. | |
| 5,121,094 | A | 6/1992 | Ting et al. | |
| 5,134,888 | A | 8/1992 | Zylka et al. | |
| 5,152,672 | A | 10/1992 | Miyazawa et al. | |
| 5,201,673 | A | 4/1993 | Minezawa et al. | |
| 5,219,041 | A | 6/1993 | Greve | |
| 5,252,036 | A | 10/1993 | Bunch et al. | |
| 5,315,878 | A | 5/1994 | Birenheide | |
| 5,471,015 | A | 11/1995 | Paterek et al. | |
| 5,493,073 | A | 2/1996 | Honkomp | |
| 5,503,542 | A | 4/1996 | Grassbaugh et al. | |
| 5,513,603 | A * | 5/1996 | Ang et al. | 123/90.37 |
| 5,522,267 | A | 6/1996 | Lewis | |
| 5,580,282 | A * | 12/1996 | Paterek | 439/685 |
| 5,584,716 | A * | 12/1996 | Bergman | 439/282 |
| 5,669,763 | A | 9/1997 | Pryce et al. | |
| 5,712,428 | A | 1/1998 | Schleiferbock et al. | |
| 5,746,622 | A * | 5/1998 | Consoli et al. | 439/521 |
| 5,750,899 | A | 5/1998 | Hegner et al. | |
| 5,756,899 | A | 5/1998 | Ugai et al. | |
| 5,831,170 | A | 11/1998 | Sokn | |
| 5,872,315 | A | 2/1999 | Nagase et al. | |
| 5,941,730 | A | 8/1999 | Uchiyama et al. | |
| 5,984,645 | A | 11/1999 | Cummings | |
| 6,037,423 | A * | 3/2000 | Nagano et al. | 525/438 |
| 6,102,666 | A | 8/2000 | Albrecht | |
| 6,140,592 | A | 10/2000 | Paterek et al. | |
| 6,224,348 | B1 | 5/2001 | Fukanuma et al. | |
| 6,276,901 | B1 | 8/2001 | Farr et al. | |
| 6,290,528 | B1 * | 9/2001 | Moore et al. | 439/367 |
| 6,332,327 | B1 | 12/2001 | Street et al. | |
| 6,350,630 | B1 | 2/2002 | Wildgen | |
| 6,351,996 | B1 | 3/2002 | Nasiri et al. | |
| 6,361,281 | B1 | 3/2002 | Wurth et al. | |
| 6,372,993 | B1 | 4/2002 | Eckels et al. | |
| 6,375,497 | B1 | 4/2002 | DiFlora | |
| 6,422,830 | B1 | 7/2002 | Yamada et al. | |
| 6,435,017 | B1 | 8/2002 | Nowicki, Jr. et al. | |
| 6,454,612 | B1 * | 9/2002 | Wang | 439/694 |
| 6,484,585 | B1 | 11/2002 | Sittler et al. | |
| 6,607,367 | B1 | 8/2003 | Shibamoto et al. | |
| 6,716,009 | B2 | 4/2004 | Sowa et al. | |
| 6,752,646 | B2 | 6/2004 | McCoy | |
| 6,755,631 | B2 * | 6/2004 | Kawashima et al. | 417/572 |
| 6,779,989 | B2 | 8/2004 | Makino et al. | |
| 6,866,487 | B2 | 3/2005 | Abe et al. | |
| 6,883,379 | B2 | 4/2005 | Kaneko et al. | |
| 6,910,904 | B2 | 6/2005 | Herrick et al. | |
| 6,923,068 | B2 | 8/2005 | Barron | |
| 6,925,885 | B2 | 8/2005 | Ishio et al. | |
| 7,056,104 | B2 | 6/2006 | Kimura et al. | |
| 7,077,694 | B2 | 7/2006 | Nakano et al. | |
| 7,108,489 | B2 | 9/2006 | Yap | |
| 7,252,005 | B2 | 8/2007 | Schulman | |
| 7,290,989 | B2 | 11/2007 | Yayanth | |
| 7,559,794 | B2 | 7/2009 | Taguchi et al. | |
| 7,866,964 | B2 | 1/2011 | Jayanth | |
| 8,235,687 | B2 | 8/2012 | Hasegawa | |
| 2002/0081899 | A1 | 6/2002 | Korber | |
| 2002/0127120 | A1 | 9/2002 | Hahn et al. | |
| 2002/0130770 | A1 | 9/2002 | Keyworth et al. | |
| 2002/0155741 | A1 * | 10/2002 | Herrick et al. | 439/199 |
| 2002/0182935 | A1 | 12/2002 | Monde et al. | |
| 2004/0020299 | A1 | 2/2004 | Freakes et al. | |
| 2004/0118146 | A1 | 6/2004 | Haller et al. | |
| 2005/0028585 | A1 | 2/2005 | Matsumura et al. | |
| 2005/0028596 | A1 | 2/2005 | Gall | |
| 2005/0217383 | A1 | 10/2005 | Tohyama et al. | |
| 2006/0013697 | A1 | 1/2006 | Uratani | |
| 2006/0068626 | A1 | 3/2006 | Hasegawa | |
| 2006/0141838 | A1 | 6/2006 | Kertesz | |
| 2006/0144153 | A1 | 7/2006 | Brosh | |
| 2006/0211810 | A1 | 9/2006 | Persigehl et al. | |
| 2006/0275143 | A1 | 12/2006 | Yayanth | |
| 2007/0184697 | A1 | 8/2007 | Taguchi et al. | |
| 2008/0136122 | A1 * | 6/2008 | Gambier | 277/650 |
| 2009/0060749 | A1 * | 3/2009 | Hoying et al. | 417/1 |
| 2009/0234051 | A1 | 9/2009 | Endtner et al. | |

FOREIGN PATENT DOCUMENTS

| | | | |
|---|---|---|---|
| EP | 1020646 | A1 | 7/2000 |
| JP | 02104995 | | 4/1990 |
| JP | 09032775 | A | 2/1997 |
| JP | 2001-116638 | A | 4/2001 |
| JP | 2006097557 | | 4/2006 |
| WO | 2006013872 | A1 | 2/2006 |
| WO | 2007/074852 | A1 | 7/2007 |

OTHER PUBLICATIONS

Summary of the Second Office Action received from the Mexican Institute of Industrial Property (IMPI) regarding Application No. PA/a/2006/005167. Summary provided by Goodrich, Riquelme y Asociados on Mar. 20, 2009.

Summary of the Third Office Action received from the Mexican Institute of Industrial Property (IMPI) regarding Application No. PA/a/2006/005167. Summary provided by Goodrich, Riquelme y Asociados on Sep. 3, 2009.

Partial European Search Report dated Sep. 2, 2009 regarding Application No. EP05256767.

Chinese Second Office Action dated Jan. 8, 2010 and issued in connection with a corresponding Chinese Application. Translation prepared by Unitalen Attorneys at Law.

Summary of the Fourth Office Action received from the Mexican Institute of Industrial Property (IMPI) regarding Application No. PA/a/2006/005167. Summary provided by Goodrich, Riquelme y Asociados on Mar. 25, 2010.

International Preliminary Report on Patentability dated Nov. 10, 2009 regarding International Application No. PCT/US2008/005971.

First Office Action regarding Chinese Patent Application No. 200880015473.1, dated May 23, 2011. English translation provided by Unitalen Attorneys at Law.

Non-final Office Action for U.S. Appl. No. 12/115,651, dated Aug. 11, 2011.

Final Office Action for U.S. Appl. No. 12/115,651, dated Jan. 6, 2012.

(56) References Cited

OTHER PUBLICATIONS

International Preliminary Report on Patentability regarding International Application No. PCT/US2008/010228 dated Mar. 2, 2010.
First Office Action regarding Chinese Patent Application No. 200880104495.5, dated Apr. 19, 2011. English translation provided by Unitalen Attorneys at Law.
Non-Final Office Action for U.S. Appl. No. 12/199,467, dated Jul. 29, 2011.
Final Office Action for U.S. Appl. No. 12/199,467, dated Jan. 18, 2012.
Non-Final Office Action for U.S. Appl. No. 11/134,130, dated Jun. 18, 2010.
Final Office Action for U.S. Appl. No. 11/134,130, dated Mar. 9, 2010.
Non-Final Office Action for U.S. Appl. No. 11/134,130, dated Oct. 23, 2009.
Final Office Action for U.S. Appl. No. 11/134,130, dated May 14, 2009.
Non-Final Office Action for U.S. Appl. No. 11/134,130, dated Dec. 19, 2008.
International Search Report regarding International Application No. PCT/US2008/010228 dated Feb. 3, 2009.
Written Opinion of the International Searching Authority regarding International Application No. PCT/US2008/010228 dated Feb. 3, 2009.
International Search Report regarding International Application No. PCT/US2008/005971 dated Sep. 30, 2008.
Written Opinion of the International Searching Authority regarding International Application No. PCT/US2008/005971 dated Sep. 30, 2008.
Advisory Action Before the Filing of an Appeal Brief regarding U.S. Appl. No. 11/134,130 dated Oct. 24, 2008.
Office Action dated Jul. 9, 2008 regarding U.S. Appl. No. 11/134,130.
Office Action dated Dec. 21, 2007 regarding U.S. Appl. No. 11/134,130.
Office Action dated Aug. 13, 2007 regarding U.S. Appl. No. 11/134,130.
Office Action dated Feb. 23, 2007 regarding U.S. Appl. No. 12/134,130.
International Search Report regarding Application No. PCT/US2010/028667, mailed Oct. 28, 2010.
Written Opinion of the International Searching Authority regarding Application No. PCT/US2010/028667, mailed. Oct. 28, 2010.
Final Office Action for U.S. Appl. No. 12/199,467, mailed Sep. 9, 2013.
Non-Final Office Action for U.S. Appl. No. 12/199,467, mailed Dec. 26, 2013.
First Office Action regarding Chinese Application No. 201080013757.4, dated Sep. 2, 2013, and Search Report. English translation provided by Unitalen Attorneys at Law.
Non-Final Office Action for U.S. Appl. No. 12/199,467, mailed May 20, 2013.
Second Office Action regarding Chinese Application No. 201080013757.4, dated Apr. 16, 2014, and Supplementary Search Report. English translation provided by Unitalen Attorneys at Law.
Final Office Action regarding U.S. Appl. No. 12/199,467, mailed Apr. 7, 2014.

* cited by examiner

COMPRESSOR PLUG ASSEMBLY

CROSS-REFERENCE TO RELATED APPLICATIONS

This application claims the benefit of U.S. Provisional Application No. 61/164,149, filed on Mar. 27, 2009. The entire disclosure of the above application is incorporated herein by reference.

FIELD

The present disclosure relates to a compressor and a plug assembly for an electric terminal of a compressor.

BACKGROUND

The statements in this section merely provide background information related to the present disclosure and may not constitute prior art.

Compressors typically include at least one terminal assembly for electrically coupling a motor of the compressor to a power source. A plug is typically received by the terminal assembly and serves as an interface between the power source and the terminal assembly to selectively supply the terminal assembly and, thus, the compressor motor with power.

SUMMARY

A compressor including a shell, a compression mechanism disposed within the shell, a motor actuating the compression mechanism, and a terminal body secured to the shell, may further include at least one conductor pin extending through the terminal body and a fence disposed around the terminal body and secured to the shell. A plug assembly having an inner core surrounded by an outer body includes at least one electrical receptacle housed by the inner core for selective electrical communication with the at least one conductor pin. A seal may be integrally formed with the outer body and may engage the fence when the at least one electrical receptacle is in electrical communication with the at least one conductor pin.

In some variations, at least one of the inner core and the outer body may be formed from a rigid thermoset or thermoplastic material. The inner core and the outer body may alternatively or additionally be formed of the same or different rigid and non-flexible thermoset or thermoplastic materials. A retainer may be provided for securing the plug assembly to the fence. The retainer may be attached to the plug assembly by a tether in each of the engaged state and the disengaged state.

In another configuration, a compressor includes a shell, a compression mechanism disposed within the shell, a motor for actuating the compression mechanism, and a terminal body secured to the shell. At least one conductor pin extends through the terminal body, and a fence is disposed around the terminal body and secured to the shell. A plug assembly includes an outer body and a seal extending around a perimeter and covering a distal end of the outer body.

In some variations, the plug assembly may include an inner core and an outer body formed from a rigid thermoset or thermoplastic material. Also, a retainer may be provided for securing the plug assembly to the fence. The retainer may optionally be attached to the plug assembly by a tether in each of the engaged state and the disengaged state.

In another configuration, a plug assembly for a compressor includes an inner core and an outer body surrounding the inner core. At least one electrical receptacle is housed by the inner core and a seal is mechanically and chemically attached to the outer body.

In some variations, at least one of the inner core and the outer body may be formed from a rigid thermoset or thermoplastic material. Optionally, the material may be polyethylene terephthalate and the seal may be formed from a thermoplastic polyester copolymer. The inner core and the outer body may each be formed of different rigid and non-flexible thermoset or thermoplastic materials.

A method of manufacturing a plug assembly for a compressor includes molding an inner core having at least one connector and at least one terminal connection assembly. The method may further include molding a rigid and non-flexible outer body over the inner core and molding a seal over a portion of the outer body.

Molding of the outer body over the inner core may include molding a different material than the inner core or may include molding the same material as the inner core. The processes for molding the inner core, molding the outer body, or molding the seal over the portion of the outer body may include injection molding. Optionally, molding a seal over the portion of the outer body may include covering a distal end of the outer body with the seal. This may further include molding a thermoplastic polyester copolymer over a portion of the outer body.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
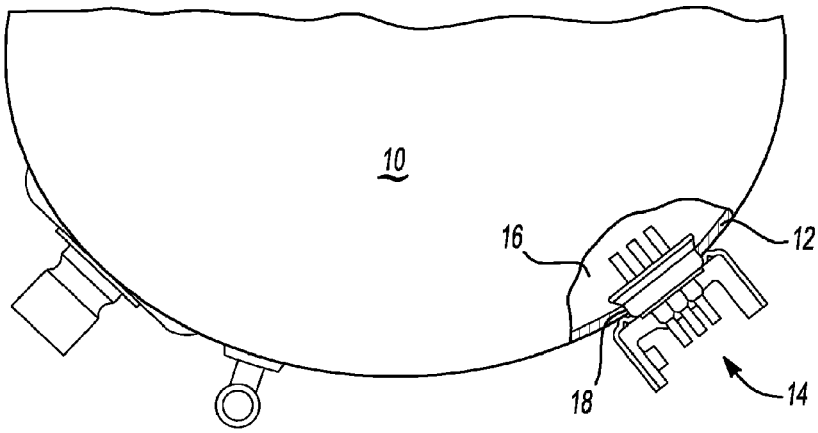
FIG. 1 is a partial top view of a compressor incorporating a terminal assembly.

The following description is merely exemplary in nature and is not intended to limit the present disclosure, application, or uses. It should be understood that throughout the drawings, corresponding reference numerals indicate like or corresponding parts and features.

FIG. 1 illustrates a compressor assembly 10 that may include a hermetic shell 12 and a terminal 14. The compressor assembly 10 may be a scroll compressor, a reciprocating compressor, or any other type of compressor known to one skilled in the art. The shell 12 may include a sealed chamber 16 within which a motor (not shown) and compression mechanism (not shown) may be disposed. The terminal 14 may be sealingly disposed within an aperture 18 that extends through the shell 12. The sealed relationship between the terminal 14 and the shell 12 maintains the integrity of the sealed chamber 16 and may provide the chamber 16 with a hermetic seal. The terminal 14 may provide for the electrical connection between an external source of electrical power (not shown) and the motor disposed within the chamber 16.

With particular reference to FIGS. 2-6, the terminal 14 may include a plurality of conductor pins 22, a terminal body 24, a plurality of fused glass insulators 26, a plurality of ceramic insulators 28, a silicone-rubber molding 30, and a fence 32. The terminal body 24 may be a cup-shaped metal member defining a plurality of holes 34 and may be sealingly disposed within aperture 18 by resistance welding or other methods known in the art.

Each of holes 34 may receive a respective fused-glass insulator 26, which may be sealingly fused to both the terminal body 24 and a respective conductor pin 22. Each conductor pin 22 may extend through a respective fused-glass insulator 26 to provide electrical communication between an exterior and interior of the shell 12. Each conductor pin 22 may include a reduced-diameter section 36 that acts as a fuse-link in the event of an internal short circuit. While the reduced-diameter sections 36 are shown as being located within the sealed chamber 16, the reduced-diameter sections 36 could alternatively be located on the outside of the shell 12.

Each of the conductor pins 22 may include a respective ceramic insulator 28 secured to an end of the conductor pin 22 that extends into the chamber 16. The ceramic insulators 28 may insulate the conductor pins 22 and their associated connection to the motor within the chamber 16 from contact with the terminal body 24 as well as provide insulation between adjacent pins 22. The silicon rubber molding 30 may be located on the outside of the terminal body 24 and may include a plurality of upstanding jackets 40 that extend from a base 42. The upstanding jackets 40 may be equal to and arranged in the same pattern as the plurality of conductor pins 22. Each of the upstanding jackets 40 may include an aperture 44 extending through the molding 30 and may receive a respective conductor pin 22. The relationship between the apertures 44 and the conductor pins 22 may serve to both seal and provide oversurface insulation protection for the conductor pins 22.

The fence 32 may be physically secured to the outside of the shell 12 by resistance welding or other methods known to those skilled in the art. In this regard, the terminal body 24 and the fence 32 may be simultaneously resistance welded to the shell 12 to provide a hermetic seal. The fence 32 may include a flange 46 having a welding bead 48 that extends circumferentially around the flange 46 and enhances the resistance welding operation that secures and seals the fence 32 to the shell 12.

The fence 32 may include an opening 49 that engages the terminal body 24 to locate the fence 32 on the shell 12 and to locate the fence 32 with respect to the conductor pins 22. Locating the fence 32 with respect to the conductor pins 22 allows for a close fit between a plug assembly 54 and both the terminal 14 and the fence 32. The fence 32 may also include a cavity 50 within which the conductor pins 22 may be located. Attachment between the fence 32 and the shell 12 provides a seal that prohibits moisture and/or debris from leaking into the cavity 50 and causing corrosion of the conductor pins 22.

Figure 2:
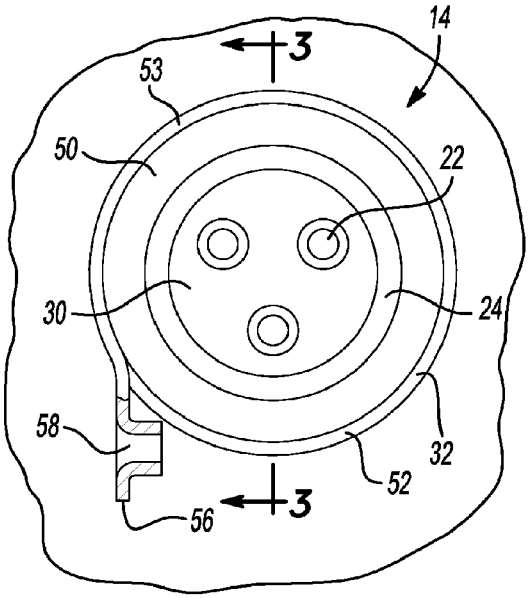
FIG. 2 is a front view of the terminal assembly of FIG. 1.
Figure 3:
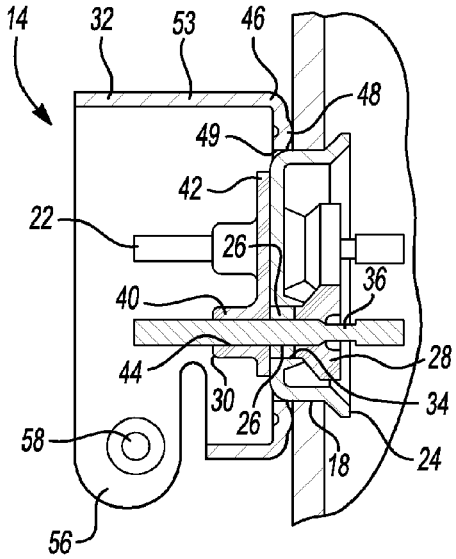
FIG. 3 is a cross-sectional view of the terminal assembly of FIG. 1 taken along line 3-3 of FIG. 2.
Figure 4:
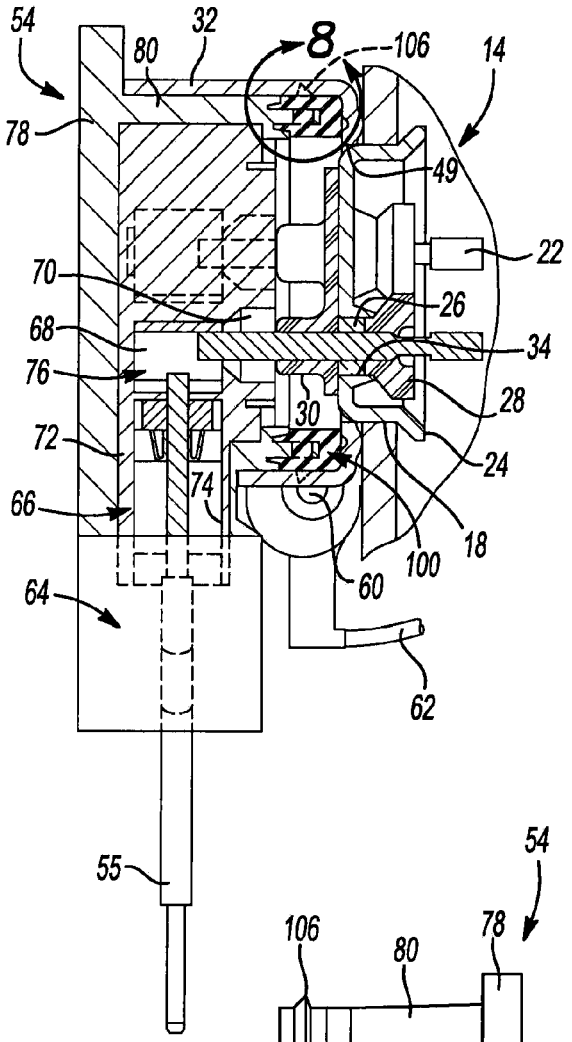
FIG. 4 is a cross-sectional view of the terminal assembly of FIG. 1 and a plug assembly in accordance with the principles of the present disclosure.
Figure 5:
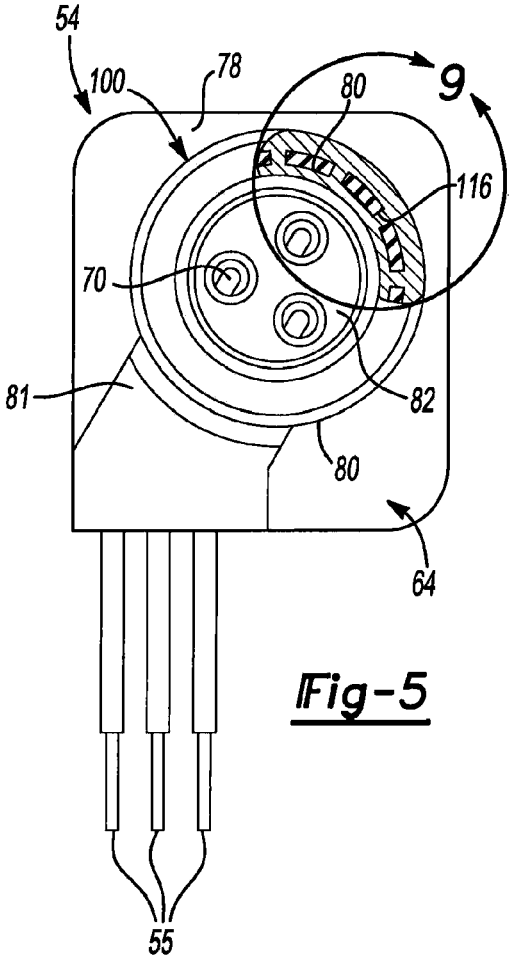
FIG. 5 is a front view of the plug assembly of FIG. 4 with part of a seal assembly removed to detail interaction between the seal assembly and a body of the plug assembly.
Figure 6:
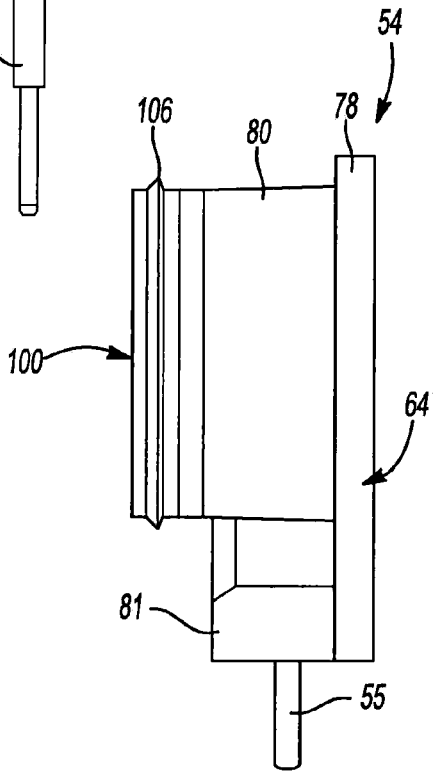
FIG. 6 is a side view of the plug assembly of FIG. 4.
Figure 7:
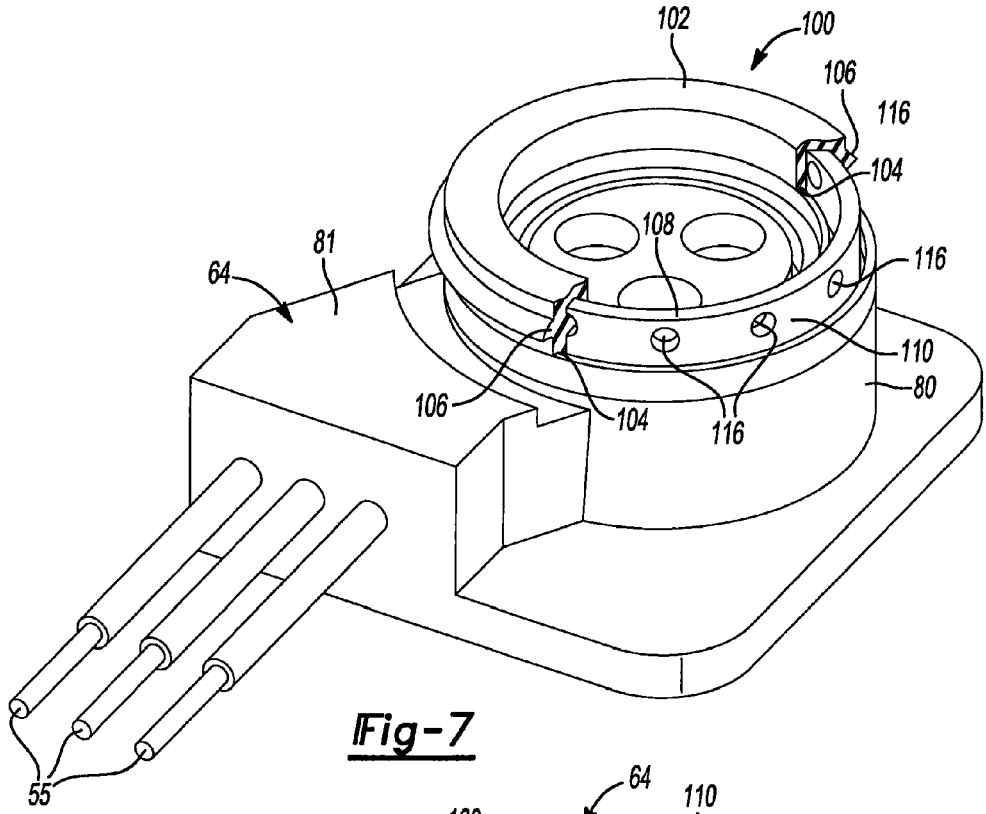
FIG. 7 is a perspective view of the plug assembly of FIG. 4 with part of a seal assembly removed to show a portion of a body of the plug assembly.

With reference to FIGS. 2-4, the fence 32 may include an opening 52 that receives the plug assembly 54. The opening 52 may be formed by removing a portion of the wall 53 of the fence 32, whereby the removed-wall portion is bent out in a direction substantially perpendicular to the conductor pins 22 to form a grounding lug 56. The grounding lug 56 may include an aperture 58 that receives a self-tapping screw 60 for connecting a grounding wire 62 to the terminal body 24.

In addition to providing an interface between the terminal 14 and the plug assembly 54, the fence 32 also protects the conductor pins 22 from damage. For example, the fence 32 protects the conductor pins 22 from damage caused during manufacturing of the compressor assembly 10, during manufacturing of the apparatus utilizing compressor assembly 10, and during servicing of the compressor assembly 10 and/or the apparatus utilizing the compressor assembly 10.

The plug assembly 54 allows for the connection of the portion of the conductor pins 22 located outside of the shell 12 to the plurality of wires 55 that extend between the plug assembly 54 and the external supply of electrical power. The plug assembly 54 may include a molded body formed of a dual-body structure. For example, the plug assembly 54 may include a molded-outer body 64 surrounding a molded-inner core 66. The inner core 66 houses connectors 68 that provide a female-electrical receptacle 70 for receiving a respective conductor pin 22. The plurality of receptacles 70 are equal in number to and arranged in the identical pattern as the conductor pins 22 of terminal 14. The connection between the conductor pins 22 and the receptacles 70 provides for both an electrical connection between the conductor pins 22 and receptacles 70 as well as a mechanical connection that maintains the plug assembly 54 in a desired position relative to the terminal 14 and fence 32. In addition, the location of the receptacles 70 within the plug assembly 54 insures that separation between each of the wires 55 is maintained.

The inner core 66 also includes a radially extending housing 72 having a plurality of conduits 74. The conduits 74 provide access into the inner core 66 for the plurality of wires 55 that extend between plug assembly 54 and the external source of electrical power. The housing 72 positions the wires 55 relative to the receptacles 70 and associated connectors 68 to allow the wires 55 to be in electrical communication with the conductor pins 22 when the conductor pins 22 are received within the receptacles 70. The conduits 74 house terminal-connection assemblies 76 that allow electrical communication between wires 55 and connectors 68 (FIG. 4).

The outer body 64 may include an end cap 78, a connector body 80, and a housing cover 81 that surround the inner core 66. The cap 78 may seat against the outside edge of the fence 32 when the plug assembly 54 is properly installed onto the terminal 14. The seating of the cap 78 against the fence 32 aids in the sealing of cavity 50. The connector body 80 extends from the cap 78 into cavity 50 and includes a pocket 82 the provides clearance for the silicone rubber molding 30 of the terminal. While the connector body 80 is shown as including a single pocket 82, a plurality of pockets equal to and in the same pattern as the plurality of conductor pins 22 may also be incorporated. The housing cover 81 covers the radially extending housing 72.

The inner core 66 and the outer body 64 may be molded from materials such as thermoset materials or thermoplastic materials. In this regard, the inner core 66 and the outer body 64 may be formed of different thermoset or thermoplastic materials or, alternatively, may be formed of the same material. Regardless, materials that are sufficiently rigid and non-flexible, flame resistant, and electrically insulating may be used. In addition to rigidity, flame resistance, and insulation properties, the material for the inner core 66 and the outer body 64 should provide adequate chemical resistance, resistance to oil, and should be a high-temperature material.

The selected thermoset or thermoplastic material may have a rigidity defined by the tensile modulus of the selected material. In addition, the selected thermoset or thermoplastic material may have a flame resistance defined by the U.L. 94 flammability index that is capable of withstanding the IEC glow-wire-ignition test (IEC 60695-2-13). In addition, the selected thermoset or thermoplastic material may have a density in the range of 1.40 g/cm$^3$ to 2.00 g/cm$^3$, a tensile modulus in the range of 9500 Megapascal (MPa) to 18000 MPa, and for a thermoplastic material, a melting point in the range of 240 degrees Celsius to 295 degrees Celsius. The tensile modulus range for the selected thermoset or thermoplastic may be further defined between 10000 MPa to 15000 MPa. Furthermore, the selected material should be able to withstand ball-pressure testing in compliance with IEC 695-10-2 at 125 degrees Celsius. Examples of materials that are rigid, flame resistant, and electrically insulating are polyethylene terephthalate, polybutylene terephthalate, polyamide 6, polyamide 4,6, and polyamide 6,6. A glass fiber filler content that ranges between ten percent (10%) and fifty percent (50%) may be used to further increase the rigidity, synergistically improve flame resistance, and electrical insulating properties of these materials for the inner core 66 and the outer body 64.

The thermoset or thermoplastic material used in manufacturing the plug assembly 54 may be molded during a two-step process to provide the plug assembly 54 with a dual-body structure. In this regard, the inner core 66 of the plug assembly 54 including the terminal connection assemblies 76 and the connectors 68 may be molded first. After the inner core 66 is formed, the outer body 64 may be molded over the inner core 66. To mold the plug assembly 54, a vertical and/or a horizontal injection-molding process may be used. A compression-molding process could also be employed to form the inner core 66 and the outer body 64. Alternatively, the inner core 66 and the outer body 64 may be molded using different molding processes. Further, a transfer molding process may be used for thermoset materials. For example, the inner core 66 may be injection molded and the outer body 64 may be overmolded to the inner core 66 using a compression-molding process, or vice versa. Regardless, one skilled in the art would acknowledge and appreciate that any type of molding processes may be used without departing from the spirit and scope of the present teachings.

The wires 55 of the plug assembly 54 may be provided with sheathings that have different colorings to allow the plug assembly 54 to be used in a wide array of applications and by various original equipment manufacturers (OEMs). The plug assembly 54, therefore, may be provided as a kit that includes a plurality of different colored wirings that may be interchanged depending on the particular application of the plug assembly 54 and/or the particular OEM using the plug assembly 54. For example, the wirings 55 may be provided with a red wire, a blue wire, and a black wire for one application, while yellow, orange, and green wirings may be used for a different application. By providing the plug assembly 54 in a kit, each of the different colored wirings may be provided with the plug assembly 54 and changed depending on the specific application desired.

With particular reference to FIGS. 4-9, the plug assembly 54 is shown to include a seal assembly 100 associated with the outer body 64 to seal the joint between the plug assembly 54 and the terminal 14 when the plug assembly 54 is connected to the terminal 14. The seal assembly 100 may include a seal body 102, a series of extensions 104, and a flange 106. The seal body 102 extends completely around a perimeter of the connector body 80 such that a distal end 108 of the connector body 80 is covered by the seal body 102 of the seal assembly 100.

The extensions 104 of the seal assembly 100 extend generally from the seal body 102 and flank an upwardly extending portion 110 of the connector body 80. The extensions 104 may include any shape that matingly receives the upwardly extending portion 110 of the connector body 80. The overall shape of the extensions 104 may be configured to maximize the overall surface area of each extension 104 to increase the overall surface area contact between the seal assembly 100 and the connector body 80.

Figure 8:
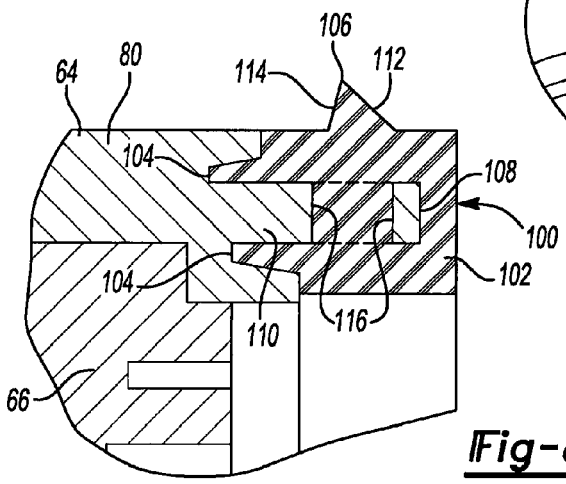
FIG. 8 is a more detailed view of the seal assembly of FIG. 5.
Figure 9:
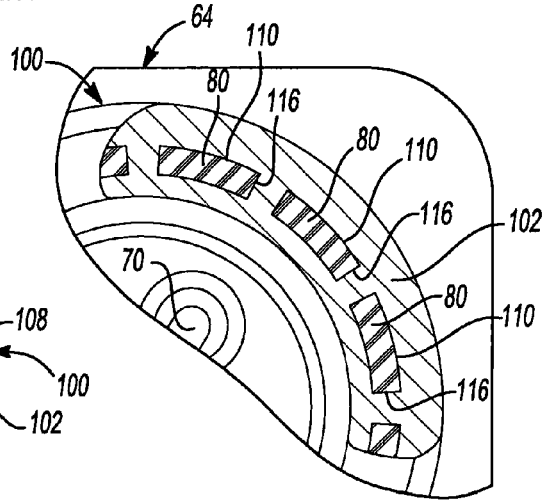
FIG. 9 is a more detailed view of the view shown in FIG. 4 illustrating the interaction between the seal assembly and a body of the plug assembly.

The flange 106 may extend around an outer peripheral surface of the seal body 102 such that the flange 106 is generally cantilevered from the seal body 102. The flange 106 may include any shape that facilitates insertion of the plug assembly 54 into the fence 32 while concurrently sealing the plug assembly 54 to the fence 32. As shown in FIG. 8, for example, the flange 106 may include a leading edge 112 that engages the fence 32 when the plug assembly 54 is inserted into the fence 32 and a trailing edge 114 that allows the flange 106 to deflect when the plug assembly 54 is inserted into the fence 32. Cooperation between the leading edge 112, the trailing edge 114, and the material of the seal assembly 100 allows the flange 106 to deflect when the plug assembly 54 is inserted into the fence 32 while concurrently sealing the region located between the plug assembly 54 and the fence 32.

As described above, the seal body 102 is generally received over the distal end 108 of the connector body 80 while the extensions 104 extend into and are attached around an upwardly extending portion 110 of the connector body 80. The seal body 102 and extensions 104 may be mechanically and/or chemically attached to the connector body 80 to maintain engagement between the seal assembly 100 and the outer body 64. For example, positioning the extensions 104 relative to the connector body 80 such that the extensions 104 flank the upwardly extending portion 110 and extend generally into the connector body 80 maximizes the surface area of the seal assembly 100 that is in contact with the connector body 80. To the extent that the seal assembly 100 is chemically bonded to the connector body 80, increasing the overall surface area of the seal assembly 100 that is in contact with the connector body 80 increases the potential of chemical adhesion of the seal assembly 100 to the connector body 80 and, thus, may increase the force required to remove the seal assembly 100 from the connector body 80.

Mechanical adhesion of the seal assembly 100 to the connector body 80 is facilitated by allowing the material of the seal assembly 100 to flow into a series of apertures 116 formed through the upwardly extending portion 110 of the connector body 80 during manufacturing of the seal assembly 100. Allowing the material of the seal assembly 100 to flow into and solidify within the apertures 116 of the connector body 80 increases the mechanical attachment of the seal assembly 100 to the connector body 80 and increases the force required to remove the seal assembly 100 from the connector body 80. In addition, allowing the material of the seal assembly 100 to flow into and solidify within the apertures 116 of the connector body 80 also increase the overall surface area of the connector body 80 that is in contact with the seal assembly 100 and, as such, may improve the chemical adhesion of the seal assembly 100 to the connector body 80.

Allowing the material of the seal assembly 100 to flow into and solidify within the apertures 116 of the connector body 80 is accomplished during manufacturing of the plug assembly 54. Specifically, during manufacturing of the plug assembly 54, the seal assembly 100 may be attached to the outer body 64 via a melt-processing process such as, for example, injection molding, transfer molding, compression molding, or an injection-compression process. During any of the foregoing melt-processing processes, the material of the seal assembly 100 is above the transition temperatures such that viscous flow is capable under reasonable plastic pressures within a molding cavity (not shown) such that the material of the seal assembly 100 generally conforms to the net shape of the mold cavity. When the material of the seal assembly 100 is capable of viscous flow, the material may likewise flow around the distal end 108, around the upwardly extending portion 110, and into apertures 116 of the connector body 80 to both chemically and/or mechanically attach the seal assembly 100 to the connector body 80 when the material of the seal assembly 100 is solidified. Once solidified, the material of the seal assembly 100 transitions from a viscous fluid or viscous fluidized state to an infinite viscosity, more commonly referred to as a solid state, thereby bonding (mechanically and/or chemically) the seal assembly 100 and outer body 64.

The material of the seal assembly 100 may be chosen to facilitate the above-described manufacturing processes, as well as to provide the plug assembly 54 with a seal that both prevents debris and other foreign matter from entering the joint between the plug assembly 54 and the fence 32 and restricts removal of the plug assembly 54 from the fence 32 when the plug assembly 54 is attached to the fence 32. In one configuration, the material of the seal assembly 100 may include an elastomer such as, for example, a thermoplastic polyester copolymer with modified hard and soft segments or other melt-processable thermoplastic elastomers such as, for example, Santoprene™. A suitable thermoplastic polyester copolymer is offered by Ticona under the trade name Riteflex® (Grade 435). The Riteflex® material offered by Ticona provides a sufficient coefficient of friction that aides in maintaining engagement of the seal assembly 100 with the fence 32 while concurrently providing the seal assembly 100 with durability.

Figure 10:
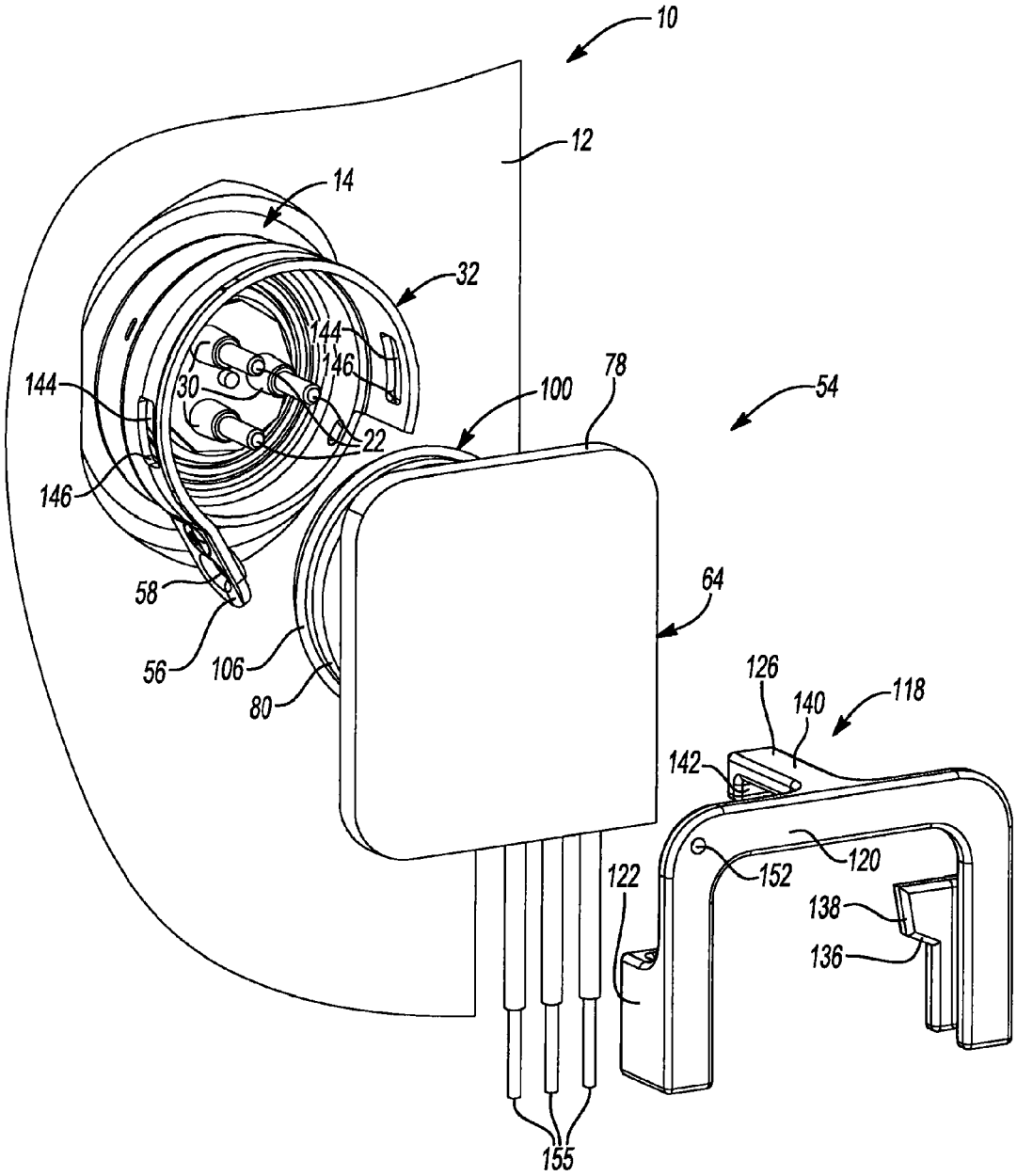
FIG. 10 is an exploded view of a plug assembly in accordance with the principles of the present disclosure including a plug retainer.
Figure 11:
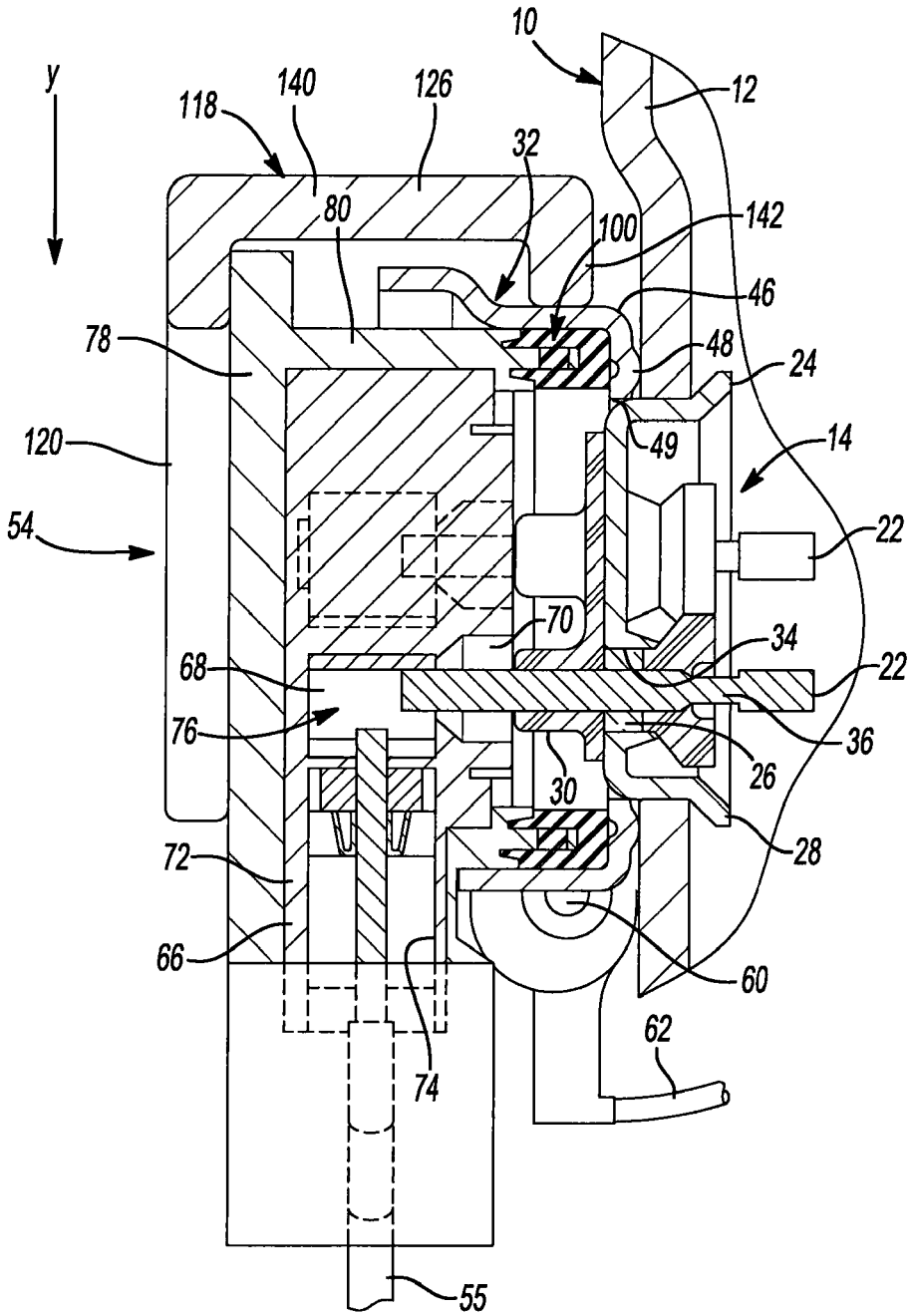
FIG. 11 is a cross-sectional view of the plug assembly and plug retainer of FIG. 10.
Figure 12:
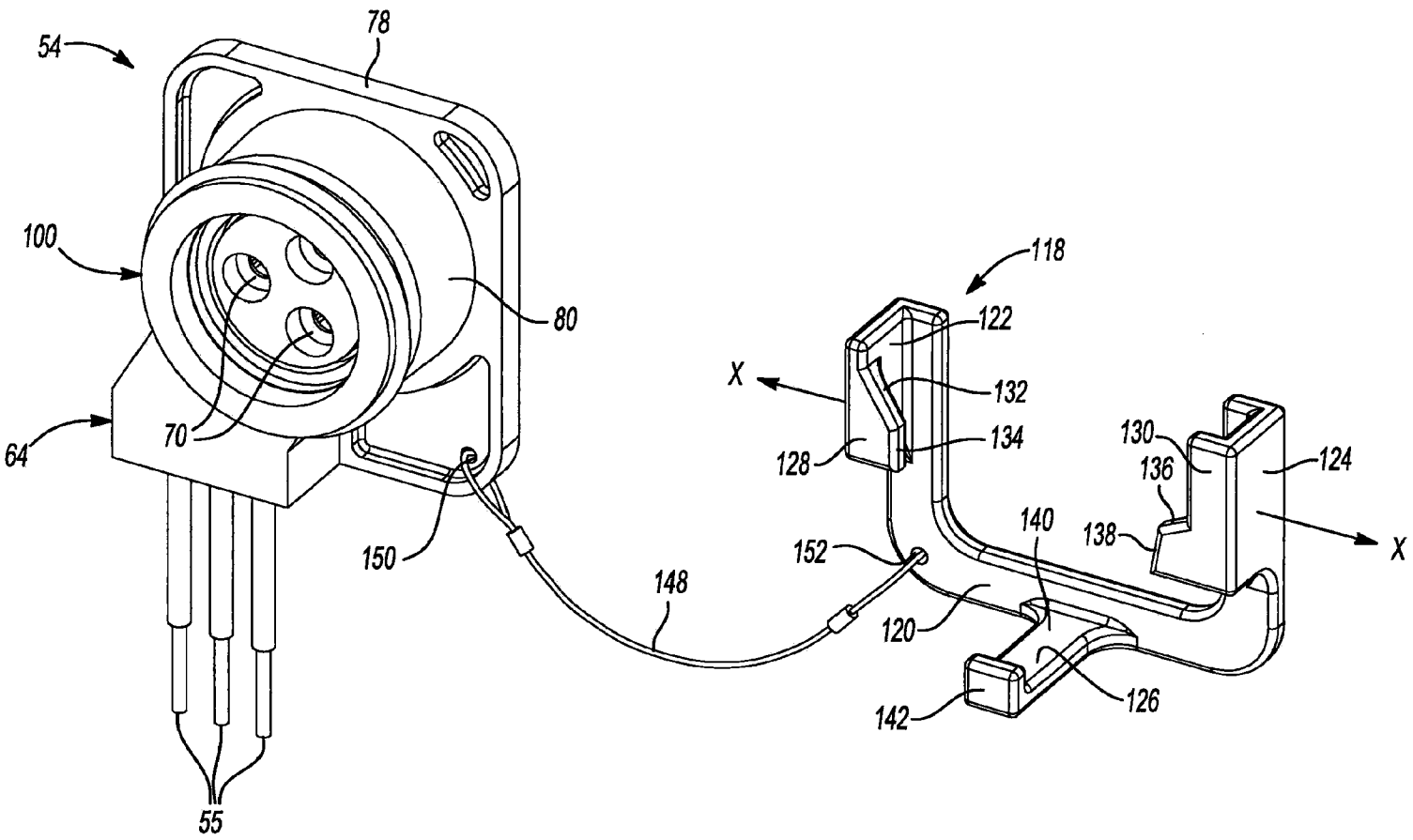
FIG. 12 is a perspective view of the plug assembly and plug retainer of FIG. 10.

With particular reference to FIGS. 10-12, the plug assembly 54 is shown as including a plug retainer 118 that may be selectively attached to the fence 32 to restrict removal of the plug assembly 54 from the fence 32. The plug retainer 118 includes a generally U-shaped main body 120, a pair of arms 122, 124 extending from the main body 120, and a projection 126. The arms 122, 124 extend from opposite portions of the main body 120 and cooperate to secure the main body 120 to the fence 32. The arm 122 may include an attachment feature 128 while the arm 124 may likewise include an attachment feature 130.

Attachment feature 128 may include a ramped portion 132 that facilitates insertion of the plug retainer 118 into the fence 32. Attachment feature 128 may also include an extension 134 that secures the plug retainer 118 relative to the fence 32. Attachment feature 130 may similarly include a ramped portion 136 that facilitates insertion of the plug retainer 118 into the fence 32 and an extension 138 that secures a position of the plug retainer 118 relative to the fence 32.

The projection 126 extends from the main body 120 generally between the arms 122, 124 and may include a cantilevered body 140 having a projection 142 disposed at a distal end thereof. The projection 142 may engage the fence 32 when the plug retainer 118 is attached to the fence 32 to exert a force on the arms 122, 124 to securely attach the plug retainer 118 to the fence 32.

With continued reference to FIGS. 10-12, operation of the plug retainer 118 will be described in detail. When the plug assembly 54 is attached to the terminal 14 such that the conductor pins 22 are respectively received within receptacles 70, the plug retainer 118 may be positioned relative to the plug assembly 54 to restrict removal of the plug assembly 54 from the terminal 14. Specifically, the main body 120 of the plug retainer 118 may be generally slid over the outer body 64 of the plug assembly 54 until the extensions 134, 138, of attachment features 128, 130, respectively, are received within slots 144 (FIG. 10) of the fence 32. Initially, a force may be applied to the plug retainer 118 such that at least one of the ramped portions 132, 136 engages an outer surface of the fence 32 to apply a force on the main body 120 in the X direction, as shown in FIG. 12. Applying a force to the main body 120 of the plug retainer 118 in the X direction causes the arms 122, 124 to move from a relaxed state to an engaged state, whereby the distance between the arms 122, 124 is increased. The arms 122, 124 remain in the engaged state until the extensions 134, 138 are received within the slots 144 of the fence 132.

Once the extensions 134, 138 are received within the slots 144 of the fence, the material of the main body 120 causes the arms 122, 124 to return to the relaxed state and snap the plug retainer 118 into engagement with the fence 32. The projection 126 may cooperate with the arms 122, 124 by applying a force on the ramped portions 132, 136 to account for any free play between the extensions 134, 138 and the slots 144. Specifically, the projection 142 may engage an outer surface of the fence 32 such that the cantilevered body 140 of the projection 126 is deflected. Deflection of the cantilevered body 140 applies a force on the arms 122, 124 in the Y direction (FIG. 11) due to the material properties and/or shape of the projection 126. Applying a force on the arms 122, 124 in the Y direction causes the main body 120 to similarly move in the Y direction until the ramped portions 132, 136 engage ends 146 (FIG. 10) of the slots 144. Engagement between the ramped portions 132, 136 and the ends 146 of the slots 144 accounts for any manufacturing tolerances between the fence 32 and the plug retainer 118 and, thus, prevents vibration of the plug retainer 118 during operation of the compressor assembly 10. Preventing vibration of the plug retainer 118 during operation of the compressor assembly 10 likewise prevents the noise associated with such vibration.

The plug retainer 118 may be removed from the fence 32 by applying a force in the X direction (FIG. 12) to move the arms 122, 124 into the engaged state and allow the plug retainer 118 to once again be slid relative to the fence 32 and plug assembly 54 in a direction substantially opposite to the Y direction (FIG. 11). Once the plug retainer 118 is removed from the fence 32 and plug assembly 54, the plug assembly 54 may be removed from the fence 32 and, as such, may be uncoupled from the terminal 14.

The plug retainer 118 may include a tether 148 that attaches the plug retainer 118 to the plug assembly 54. The tether 148 may include a braided-metal cable that is received within an aperture 150 of the plug assembly 54 and an aperture 152 of the plug retainer 118. The tether 148 may include a length that allows the plug retainer 118 to be attached to and removed from the fence 32 while concurrently allowing the plug retainer 118 to be held in close proximity to the fence 32 when the plug retainer 118 is not attached to the fence 32.

The above description of the present teachings is merely exemplary in nature and, thus, variations that do not depart from the gist of the present teachings are intended to be within the scope of the present teachings. Such variations are not to be regarded as a departure from the spirit and scope of the present teachings.

What is claimed is:

1. A compressor comprising:

a shell;

a compression mechanism disposed within said shell;

a motor for actuating said compression mechanism;

a terminal body secured to the shell;

at least one conductor pin extending through said terminal body;

a fence disposed around said terminal body and including a flange portion secured to said shell and a wall portion extending from said flange portion;

a plug assembly having an inner core surrounded by a connector body, said connector body including a plurality of apertures formed therethrough in a direction substantially perpendicular to a longitudinal axis of said at least one conductor pin;

at least one electrical receptacle housed by said inner core for selective electrical communication with said at least one conductor pin; and a seal formed over a distal end of said connector body, extending through said plurality of apertures, and simultaneously engaging said fence at said flange portion and at said wall portion when said at least one electrical receptacle is in electrical communication with said at least one conductor pin, said seal contacting said flange portion and said wall portion proximate to a junction of said flange portion and said wall portion.

2. The compressor of claim 1, wherein at least one of said inner core and said connector body are formed from a material selected from the group consisting of a rigid thermoset and a thermoplastic.

3. The compressor of claim 2, wherein said material is flame resistant.

4. The compressor of claim 1, wherein at least one of said inner core and said connector body are formed from polyethylene terephthalate.

5. The compressor of claim 1, wherein said seal is formed from a thermoplastic polyester copolymer.

6. The compressor of claim 1, wherein said inner core and said connector body are each formed of different rigid and non-flexible thermoset or thermoplastic materials.

7. The compressor of claim 1, wherein said seal is mechanically and chemically attached to said connector body.

8. The compressor of claim 1, further comprising a retainer for securing said plug assembly to said fence.

9. The compressor of claim 8, wherein said retainer includes at least one retention feature attaching said retainer to said fence.

10. The compressor of claim 9, wherein said at least one retention feature is received within an aperture of said fence.

11. The compressor of claim 9, wherein said at least one retention feature includes a ramped surface facilitating engagement of said at least one retention feature with said fence.

12. The compressor of claim 9, wherein said at least one retention feature includes a ramped surface received within an aperture of said fence when said at least one retention feature is in engagement with said fence.

13. The compressor of claim 9, wherein said at least one retention feature is deflectable from a relaxed state to an engaged state when said retainer engages said plug assembly.

14. The compressor of claim 9, wherein said at least one retention feature includes a plurality of retention features, one of said retention features being disposed approximately ninety degrees (90°) from the other of said retention features.

15. The compressor of claim 8, wherein said plug assembly is disposed substantially between said retainer and said fence.

16. The compressor of claim 8, wherein said retainer is movable between an engaged state in contact with said fence and a disengaged state disconnected from said fence.

17. The compressor of claim 16, wherein said retainer is attached to said plug assembly in each of said engaged state and said disengaged state.

18. The compressor of claim 17, wherein said retainer is attached to said plug assembly by a tether in each of said engaged state and said disengaged state.

19. The compressor of claim 8, wherein said retainer is slidably engaged with said plug assembly.

20. The compressor of claim 1, wherein said flange portion is substantially perpendicular to said wall portion.

21. A compressor comprising:

a shell;

a compression mechanism disposed within said shell;

a motor for actuating said compression mechanism;

a terminal body secured to the shell;

a plurality of conductor pins extending through said terminal body;

a fence disposed around said terminal body and secured to said shell;

a plug assembly including an end cap, a plurality of electrical receptacles, a connector body extending from said end cap and having a plurality of apertures formed through a wall of said connector body in a direction substantially perpendicular to a longitudinal axis of said plurality of conductor pins, said wall surrounding said plurality of conductor pins when said plurality of electrical receptacles are in electrical communication with said plurality of conductor pins; and a seal extending around a perimeter of said connector body and covering a distal end of said connector body, said seal extending through said plurality of apertures and sealing at an interface of said plug and said fence.

22. The compressor of claim 21, wherein said connector body is formed from a material selected from the group consisting of a rigid thermoset and a thermoplastic.

23. The compressor of claim 22, wherein said material is rigid and non-flexible.

24. The compressor of claim 21, wherein said seal includes a pair of extensions extending into said connector body in a direction substantially parallel to said longitudinal axis.

25. The compressor of claim 21, wherein said seal is formed from a thermoplastic polyester copolymer.

26. The compressor of claim 21, further comprising a retainer for securing said plug assembly to said fence.

27. The compressor of claim 26, wherein said retainer includes at least one retention feature attaching said retainer to said fence.

28. The compressor of claim 27, wherein said at least one retention feature is received within an aperture of said fence.

29. The compressor of claim 27, wherein said at least one retention feature includes a ramped surface facilitating engagement of said at least one retention feature with said fence.

30. The compressor of claim 27, wherein said at least one retention feature includes a ramped surface received within an aperture of said fence when said at least one retention feature is in engagement with said fence.

31. The compressor of claim 27, wherein said at least one retention feature is deflectable from a relaxed state to an engaged state when said retainer engages said plug assembly.

32. The compressor of claim 27, wherein said at least one retention feature includes a plurality of retention features, one of said retention feature being disposed approximately ninety degrees(90°) from the other of said retention features.

33. The compressor of claim 26, wherein said plug assembly is disposed substantially between said retainer and said fence.

34. The compressor of claim 26, wherein said retainer is movable between an engaged state in contact with said fence and a disengaged state disconnected from said fence.

35. The compressor of claim 34, wherein said retainer is attached to said plug assembly in each of said engaged state and said disengaged state.

36. The compressor of claim 35, wherein said retainer is attached to said plug assembly by a tether in each of said engaged state and said disengaged state.

37. The compressor of claim 26, wherein said retainer is slidably engaged with said plug assembly.

* * * * *